US011497262B2

(12) United States Patent
Bornstein

(10) Patent No.: US 11,497,262 B2
(45) **Date of Patent: *Nov. 15, 2022**

(54) FACE SHIELD INTEGRATION WITH EYEWEAR

(71) Applicant: Julia Bornstein, Muttontown, NY (US)

(72) Inventor: Julia Bornstein, Muttontown, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/528,134

(22) Filed: Nov. 16, 2021

(65) Prior Publication Data

US 2022/0071324 A1 Mar. 10, 2022

Related U.S. Application Data

(63) Continuation of application No. 16/908,506, filed on Jun. 22, 2020, now Pat. No. 11,206,883, which is a continuation of application No. 16/905,839, filed on Jun. 18, 2020, now Pat. No. 11,206,882.

(51) Int. Cl.
*A41D 13/11* (2006.01)
*G02C 5/22* (2006.01)

(52) U.S. Cl.
CPC ..... *A41D 13/1184* (2013.01)

(58) Field of Classification Search
CPC ..... A61F 9/029; A61F 9/025; A61F 9/045; A61F 9/02; A61F 9/022; G02C 7/16; G02C 11/12; G02C 2200/08; G02C 9/00; A41D 13/1184; A41D 13/11; A62B 18/082
See application file for complete search history.

(56) References Cited

U.S. PATENT DOCUMENTS

| | | | |
|---|---|---|---|
| 971,372 | A | 9/1910 | Hamilton |
| 1,561,958 | A | 11/1925 | Tully |
| 2,093,536 | A | 2/1936 | Alvord |
| 2,253,101 | A | 4/1939 | Thoreson |
| 2,541,242 | A | 2/1951 | Grove |
| 4,405,212 | A | 9/1983 | Cooper |
| 4,654,899 | A | 4/1987 | Harris |
| 4,701,965 | A | 10/1987 | Landis |
| 5,339,119 | A | 8/1994 | Gardner |
| 5,388,269 | A | 2/1995 | Griffin |
| 5,771,500 | A | 6/1998 | Mayes |
| 6,481,845 | B1 | 11/2002 | Gazzara |
| 10,098,787 | B2 | 10/2018 | Umentum et al. |
| 10,532,879 | B2 | 1/2020 | Ito et al. |
| 10,687,981 | B2 | 6/2020 | Calilung et al. |
| 2002/0029399 | A1 | 3/2002 | Hill |
| 2004/0025232 | A1 | 2/2004 | Hartley et al. |
| 2004/0051839 | A1 | 3/2004 | Tagawa |
| 2004/0117898 | A1 | 6/2004 | Penque, Jr. et al. |
| 2013/0014316 | A1 | 1/2013 | Castro et al. |
| 2014/0318084 | A1 | 10/2014 | Schultz |
| 2015/0351965 | A1 | 12/2015 | Umentum et al. |

*Primary Examiner* — Robert H Muromoto, Jr.

(74) *Attorney, Agent, or Firm* — Greenberg Traurig, LLP; Scott Goncher

(57) ABSTRACT

Face shields, eyewear, and kits that provide a user the ability to protect their face from solids or liquids while simultaneously providing the ability to manipulate any eyewear the user may desire to wear.

11 Claims, 7 Drawing Sheets

FACE SHIELD INTEGRATION WITH EYEWEAR

CROSS REFERENCE TO RELATED APPLICATIONS

This application is a continuation application claiming priority to and the benefit of U.S. application Ser. No. 16/908,506, filed Jun. 22, 2020, which claims priority to and the benefit of U.S. application Ser. No. 16/905,839, filed Jun. 18, 2020, each of which are hereby incorporated by reference in its entirety.

FIELD OF DISCLOSURE

The present disclosure is related to face shields allowing for the manipulation of eyewear without removal of the face shield.

BACKGROUND

Face shields provide a protective barrier for users desiring not to be exposed to various solid and liquid materials. For example, face shields are routinely used in the medical community to prevent the inhalation of airborne pathogens trapped in aerosolized particles of body fluid. Users also often want to wear some sort of eyewear to augment their vision (e.g., focusing light, block certain wavelengths of light, magnification) with use of these face shields. However, when eyewear is worn with face shields, the eyewear often becomes fogged as condensation accumulates on the lenses of the eyewear thereby inhibiting its utility. Moreover, prescription glasses could shift out of the desired location resulting in blurry vision, or the user may desire to take some eyewear such as reading glasses on or off while working. Often, in order to remove the condensation or to adjust glasses, a user is forced to remove the face shield as well. Removal of the face shield may compromise the integrity afforded by the device and/or require the user to wait until they are in an uncompromised situation before cleaning of the lenses can occur. Moreover, fogging of the eyewear is often uncomfortable for the user and inhibits the utility of these protective devices.

It is therefore an object of the present disclosure to provide face shields which limit these compromised and/or uncomfortable situations to allow for more continued use without removal.

SUMMARY

In accordance with the foregoing objectives and others, the present disclosure provides face shields whereby a user may move eyewear typically worn under a face shield without removal of the face shield itself. Accordingly, adjustments of eyewear are possible with the face shields of the present disclosure without compromising the prevention of inhalation of unwanted material (e.g., aerosolized pathogens) typically afforded by the face shield during use. It will be understood that the face shields of the present disclosure may include any device that prevents migration of foreign material to a user's face and covers the eyes including face masks and gas masks, unless otherwise indicated. In some embodiments, the face shield is a gas mask. In some embodiments, the face shield comprises a solid barrier that prevents the passage of solids and liquid therethrough, and a support strap which extends around the head of the user to position the solid barrier in front of the face of the user (e.g., to cover the eyes of a user and optionally the nose or the nose and the mouth of a user).

The face shields of the present disclosure may comprise a solid barrier that prevents the passage of solids and liquids therethrough; wherein said solid barrier comprises one or more eyewear attachment elements configured to allow for an eyewear element to be removably attached to said solid barrier; and said eyewear element comprises lenses which refract light into the eyes of a user wearing the face shield when the eyewear element is attached to the solid barrier.

In some embodiments, the face shield may comprise:

a) a solid barrier that prevents the passage of solids and liquids therethrough;

b) an eyewear attachment element configured to attach or removably attach to eyewear;

c) an eyewear movement element configured to allow movement of the eyewear with respect to the solid barrier when said eyewear is attached;

wherein the eyewear movement element is configured such that attached eyewear may be moved into a first position where the lenses of the eyewear are positioned between the solid barrier and the eyes of a user wearing the face shield; the attached eyewear may be moved into a second position where the lenses of the eyewear are not positioned between the solid barrier and the eyes of a user wearing the face shield; and movement of the eyewear from the first position to the second position can be effectuated without removal of the face shield from the face of a user.

The disclosure also relates to eyewear element dimensioned for use with the face shields as described herein. Typically, the eyewear element comprises a frame which may attach (e.g., removably attach) to one or more lenses, and be dimensioned to be attached to the face shields of the present disclosure and/or comprise one or more attachment elements such that the eyewear element can be configured to attach to a face shield during use. In some embodiments, the eyewear element comprises a frame dimensioned to be supported by the nose of a user.

Kits are also provided comprising face shields of the present disclosure and eyewear elements for use therewith. In some embodiments, the kit may comprise:

a) a solid barrier that prevents the passage of solids and liquids therethrough; wherein the solid barrier comprises one or more eyewear attachment elements configured to allow for an eyewear element to be removably attached to said solid barrier; and b) an eyewear element capable of being removably attached to the solid barrier comprising lenses which refract light into the eyes of a user wearing the face shield when the eyewear element is attached to the solid barrier.

DETAILED DESCRIPTION

Detailed embodiments of the present disclosure are disclosed herein; however, it is to be understood that the disclosed embodiments are merely illustrative of the disclosure that may be embodied in various forms. In addition, each of the examples given in connection with the various embodiments of the disclosure is intended to be illustrative, and not restrictive.

All terms used herein are intended to have their ordinary meaning in the art unless otherwise provided. All concentrations are in terms of percentage by weight of the specified component relative to the entire weight of the topical composition, unless otherwise defined.

As used herein, "a" or "an" shall mean one or more. As used herein when used in conjunction with the word "comprising," the words "a" or "an" mean one or more than one. As used herein "another" means at least a second or more.

As used herein, all ranges of numeric values include the endpoints and all possible values disclosed between the disclosed values. The exact values of all half integral numeric values are also contemplated as specifically disclosed and as limits for all subsets of the disclosed range. For example, a range of from 0.1% to 3% specifically discloses a percentage of 0.1%, 1%, 1.5%, 2.0%, 2.5%, and 3%. Additionally, a range of 0.1 to 3% includes subsets of the original range including from 0.5% to 2.5%, from 1% to 3%, from 0.1% to 2.5%, etc. It will be understood that the sum of all % of individual components will not exceed 100%.

The face shields of the present disclosure afford the ability for a user to manipulate eyewear while wearing a face shield, and to do so without removing the face shield. This may allow for a user to keep the face shield on for longer amounts of time without issues relating to the eyewear.

Figure 1A:
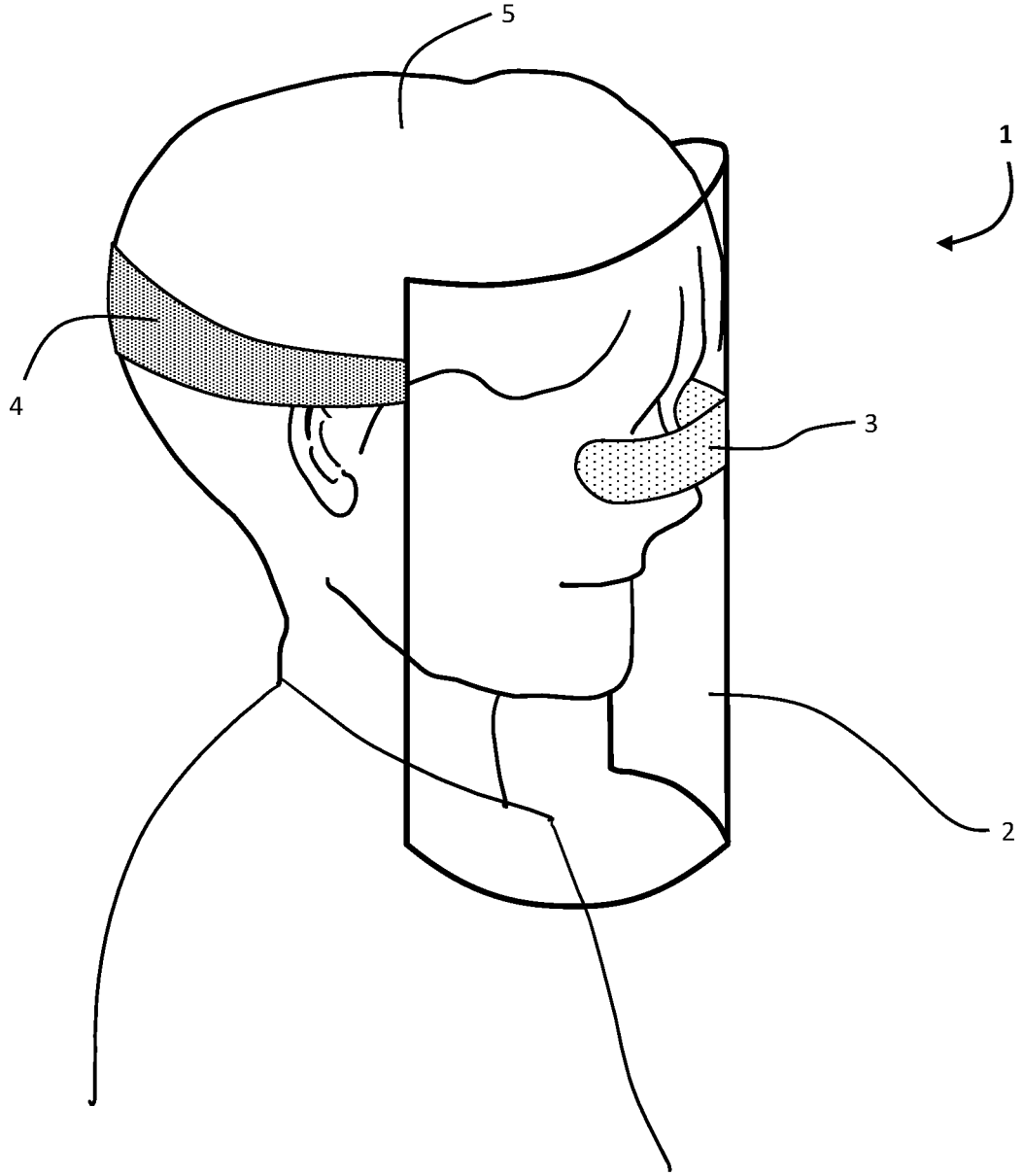
FIG. 1A is an illustration of a user wearing a face shield of the present disclosure.
Figure 1B:
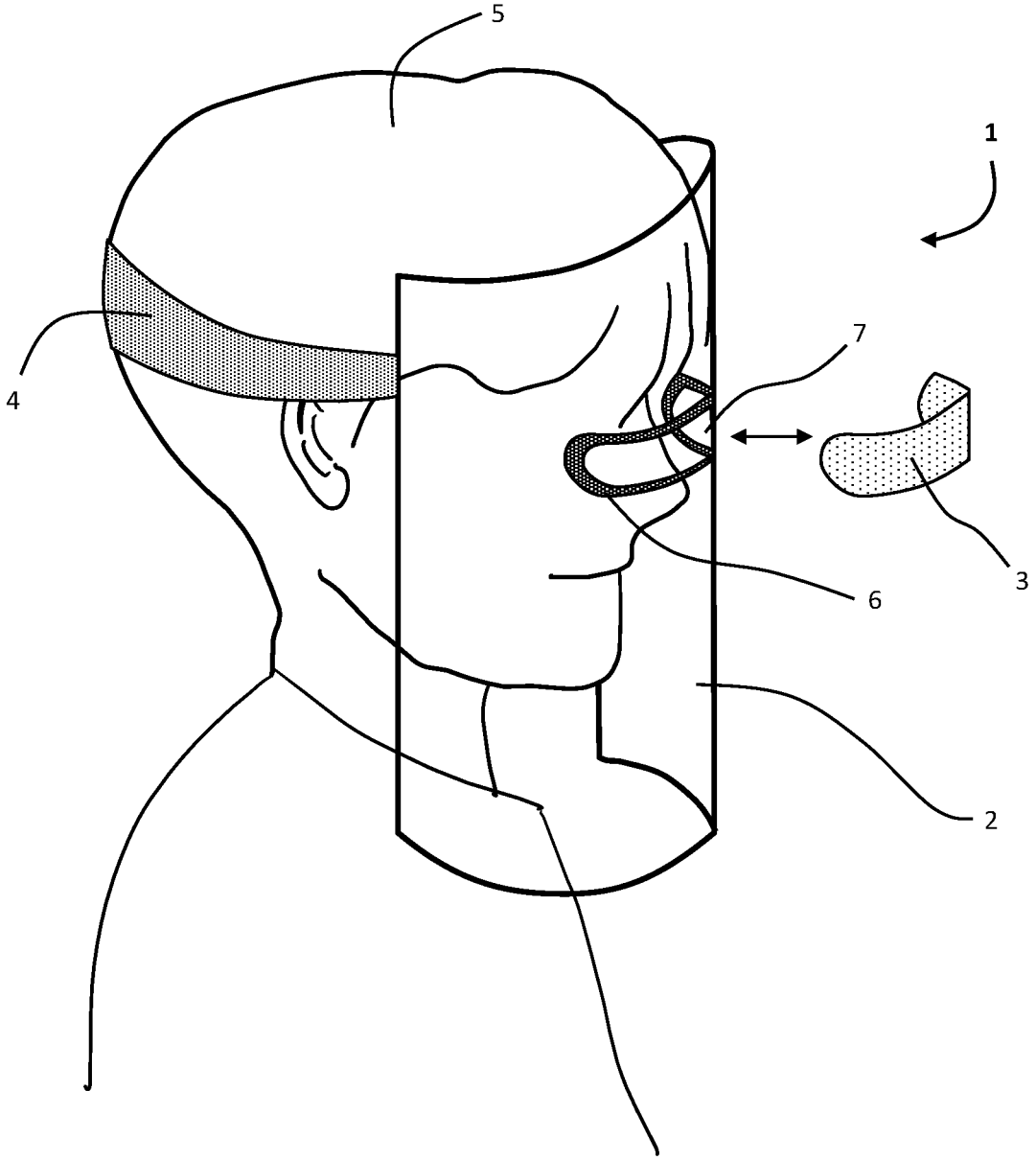
FIG. 1B is an expanded illustration of the face shield of FIG. 1A.

In some embodiments, the face shield may comprise a shield comprising a solid barrier that prevents the passage of solids and liquids therethrough; wherein the solid barrier comprises one or more eyewear attachment elements configured to allow for an eyewear element to be removably attached to said solid barrier; and the eyewear element comprises lenses which refract light into the eyes of a user wearing the face shield when the eyewear element is attached to the solid barrier. Referring now to FIGS. 1A and 1B, face shield 1 comprises solid barrier 2 which is dimensioned such that the eyes, nose, and mouth of user 5 are shielded from solids and liquids passing through solid barrier 2. Face shield 1 comprises strap 4 which extends around the head of user 5 providing support for solid barrier 2 over the face of user 5. Face shield 5 comprises an eyewear element 3 positioned proximal to the eyes of the user such that light may pass through (e.g., refract) through eyewear element 3 and into the eyes of user 5. Refraction through eyewear element 3 may occur in a prescriptive sense, for example, such that eyewear element 3 may comprises one or more lenses which reflect light in a manner to correct the vision of user 5. In some embodiments, the lens may produce a magnified image to the user (e.g., such as lenses used in reading glasses). As can be seen in FIG. 1B, eyewear element 3 is removably attached to the external surface of solid barrier 2. Solid barrier 2 comprises one or more eyewear attachment elements 7 (e.g., adhesive, snaps, loop and hook configurations such as Velcro®) which allow eyewear element 3 to be removably attached to solid barrier 2. Solid barrier 2 may further comprise a cavity 7 surrounded having one or more eyewear attachment elements 7 at the perimeter of the cavity, therefore allowing light to pass only through the eyewear element and into the eyes of user 5.

Figure 2A:
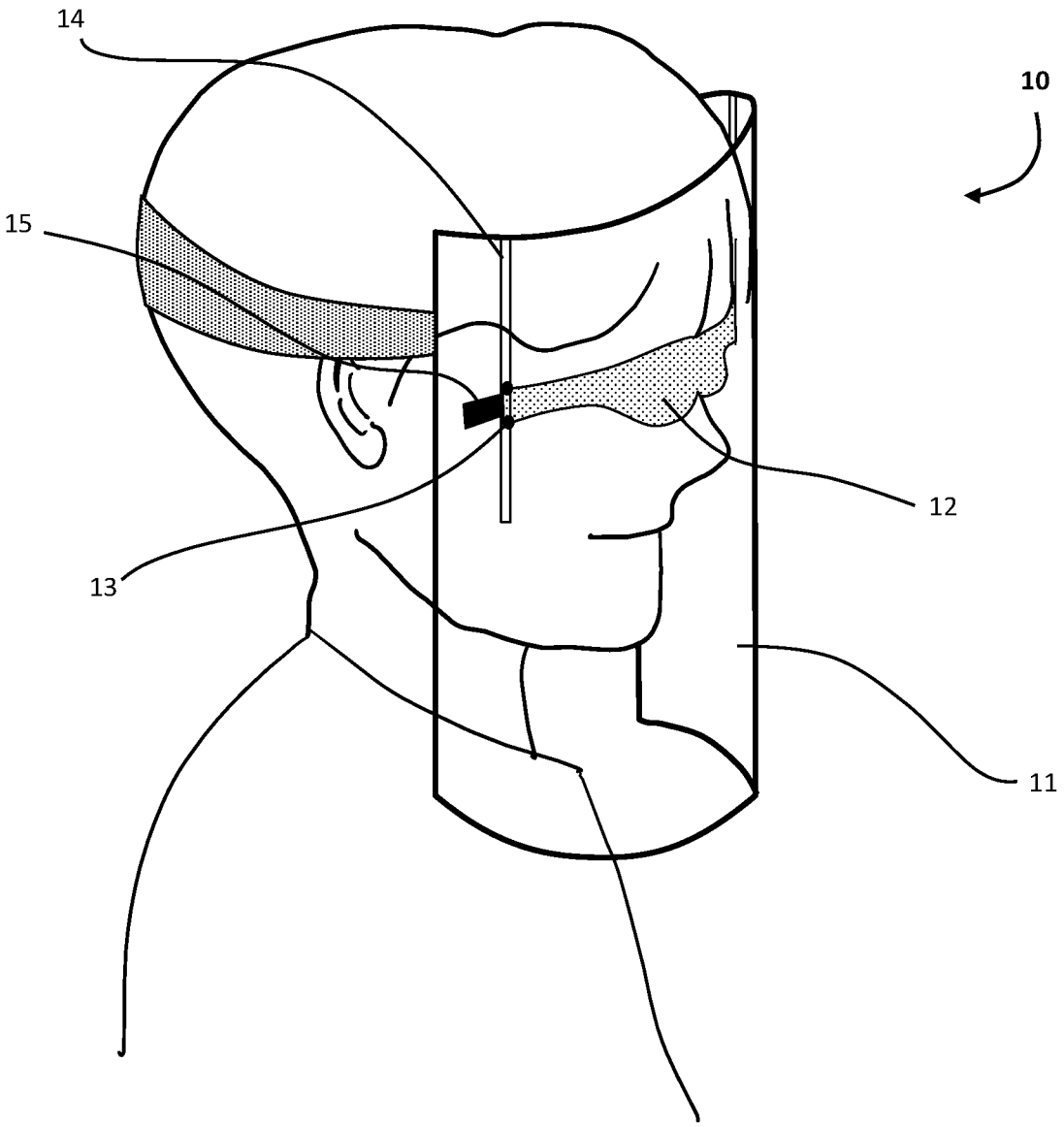
FIG. 2A is an illustration of a user wearing a face shield of the present disclosure where the eyeglass element is positioned to allow light to pass therethrough to the user's eyes.
Figure 2B:
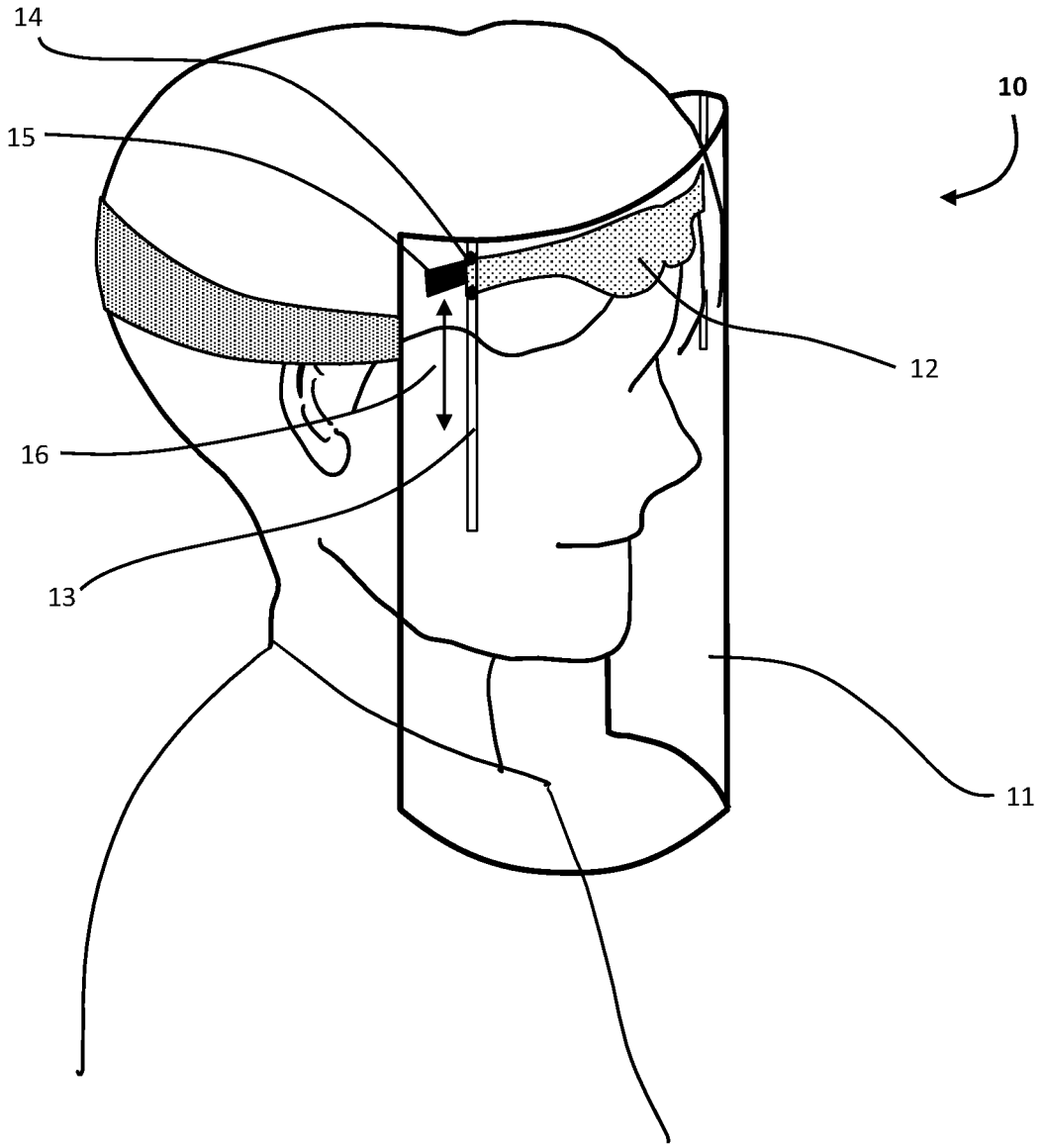
FIG. 2B is an illustration of a user wearing the face shield of FIG. 2A, wherein the eyeglass element has been moved to be positioned away from the eyes of the user.

The eyewear element may be attached at various positions of the solid barrier such that light may pass through both the solid barrier and the eyewear element. For example, the solid barrier may not comprise a cavity. In certain embodiments, the eyewear element is removably attached to the solid barrier such that the eyewear element is positioned between the solid barrier and the user's eyes. Referring now to FIGS. 2A and 2B, face shield 10 comprises solid barrier 11 which is removably attached to eyewear element 12. Eyewear element 12 is removably attached with one or more attachment elements 13 such as screws, nuts, and/or snaps. Eyewear element 12 fits into port 14 of solid barrier 11 allowing for eyewear element 12 to be positioned between solid barrier 11 and the user's eyes in a position similar to typical glasses wear. Eyewear element 12 may comprise handle 15. A user may grip handle 15 to allow eyewear element 12 to be moved away from the eyes by moving eyewear element 12 along port 14. As can be seen in FIG. 1B, eyewear element 12 may be moved away from the eyes along direction 16 by following the track of port 14.

The eyewear attachment elements may be configured for the eyewear element to be attached along the surface of the solid barrier where light passes through the solid barrier. In some embodiments, the light refracted through the lenses does not pass through the solid barrier when the eyewear element is attached to the solid barrier (e.g., the eyewear element is positioned within a cavity on the exterior surface of the face shield). In various implementations, the eyewear attachment elements are configured for the eyewear element to be attached and positioned between the solid barrier and a user's eyes when attached to the solid barrier (e.g., the eyewear element is positioned on the interior surface of the face shield, the eyewear element is positioned across the volume between the solid barrier and the users eyes and the attachment elements are on the sides of the face shield).

Figure 2C:
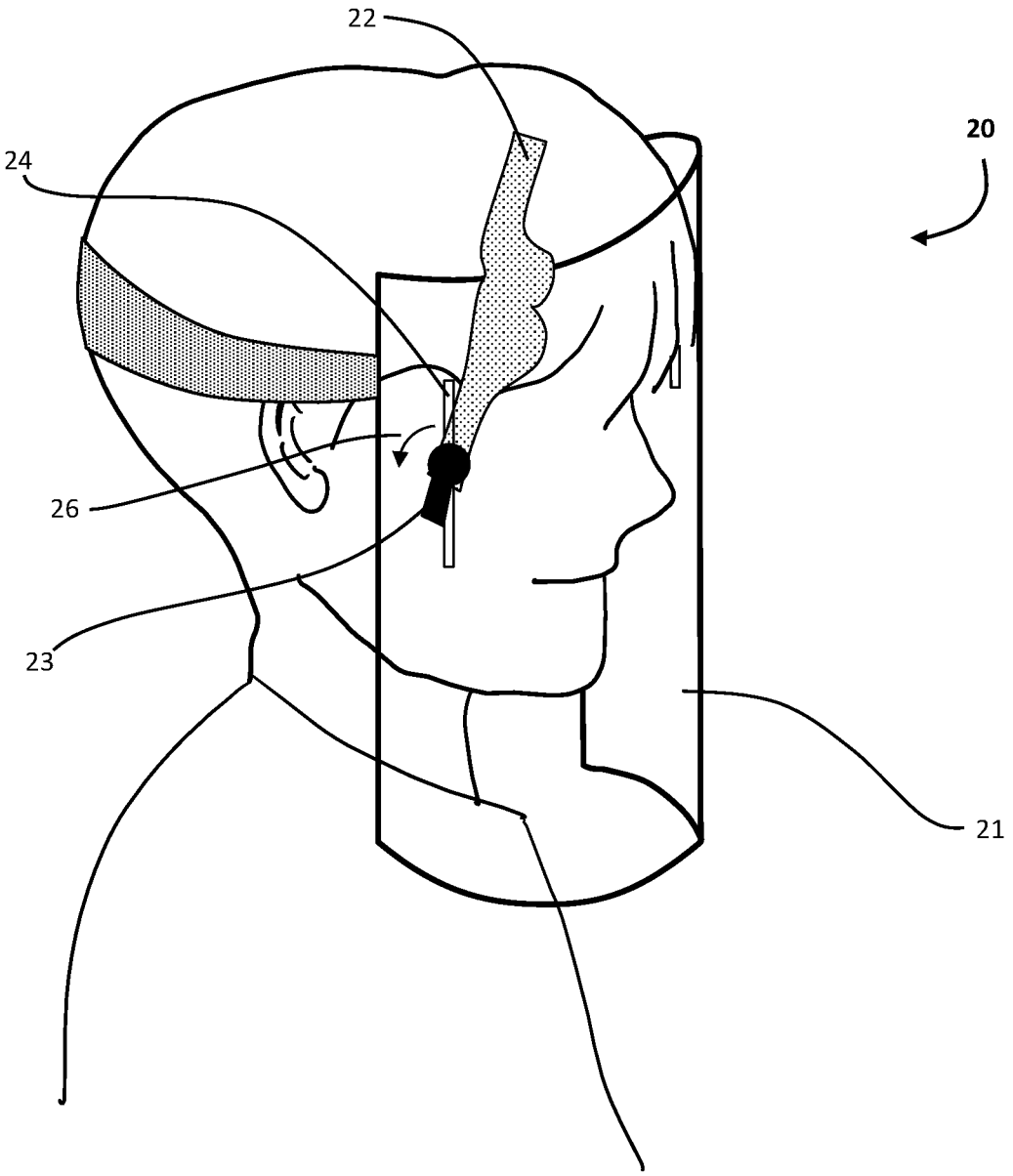
FIG. 2C is an illustration of a user wearing a face shield of the present disclosure wherein the eyeglass element has been moved to be positioned away from the eyes of the user.

Other movement paradigms of eyewear elements during use of the face shields of the present disclosure are also possible. Referring now to FIG. 2C, face shield 20 comprises solid barrier 21 having port 24 which allows for insertion of eyewear element 22 in a configuration similar that depicted in FIG. 2A. Attachment element 23 allows for the rotation 26 of eyewear element 22 away from the eyes of the user. In certain embodiments, the eyewear element may be removably attached such that it may be removed from the face shield (e.g., by removal through a port) during use without removal of the face shield from the user. In certain implementations, the eyewear element may be rotated out of the volume between the solid barrier and the user's face without removal of the face shield. Such embodiments may allow for the cleaning of the eyewear element (e.g., to remove condensation that has collected on the lenses) and/or repositioning of the eyewear element without compromising the integrity afforded by the solid barrier.

Figure 3A:
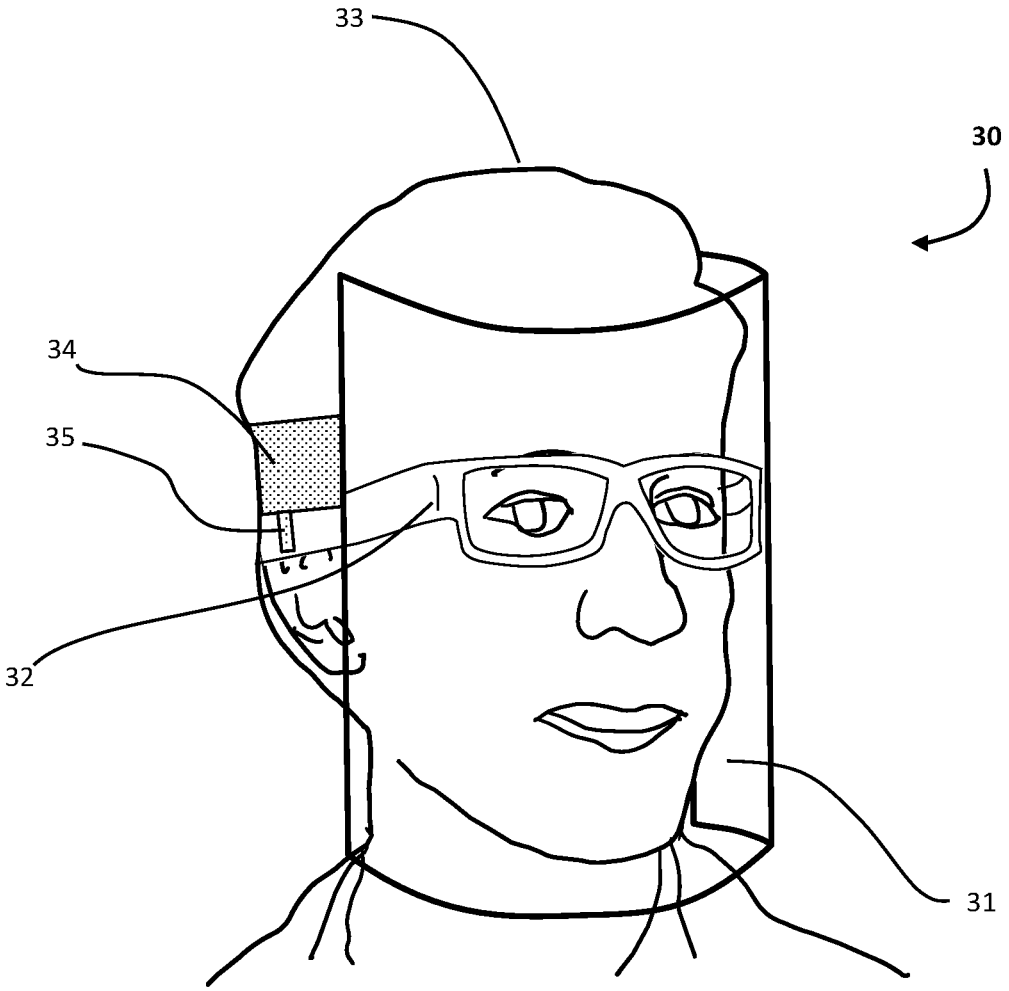
FIG. 3A is an illustration of a user wearing a face shield of the present disclosure attached to eyeglasses of the user in their typical position for use.
Figure 3B:
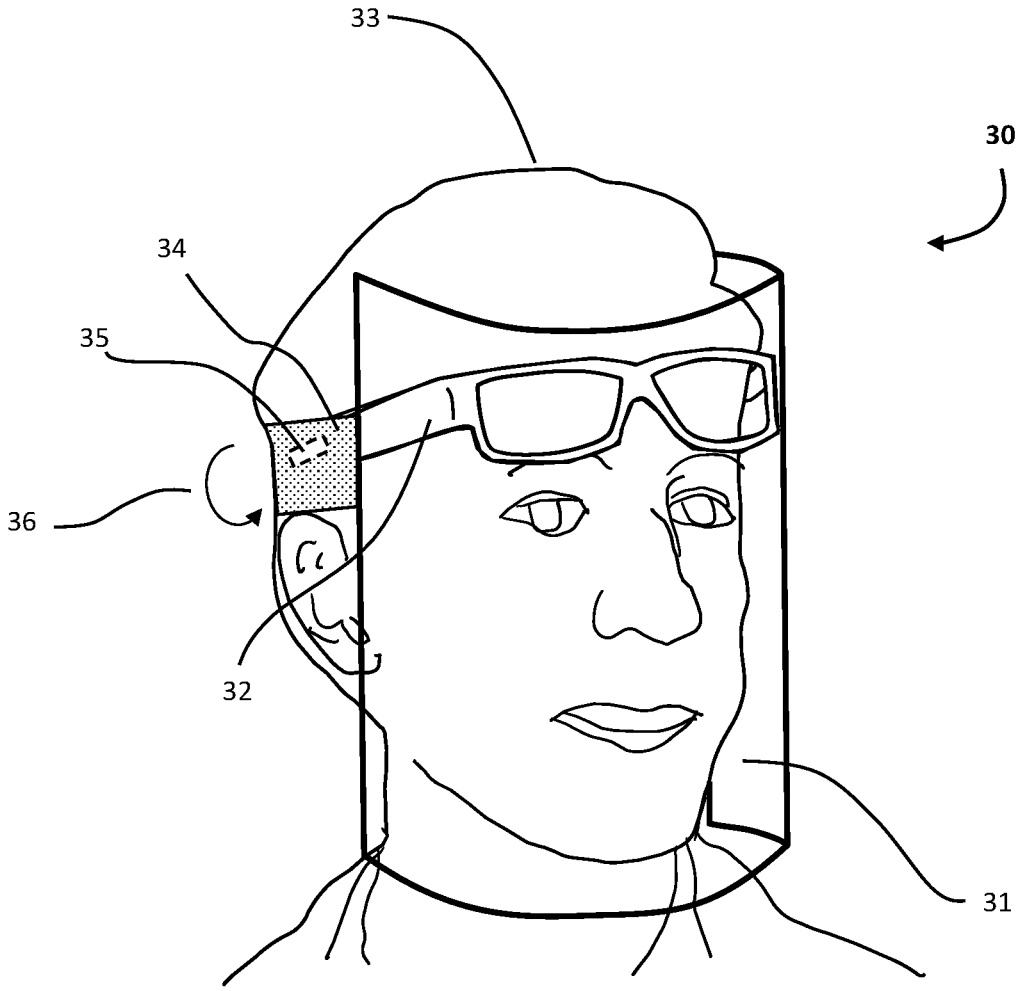
FIG. 3B is an illustration of user wearing the face shield of FIG. 3A, wherein the eyeglass have been moved away the eyes.

In certain implementations, the face shield may comprise:

a) a solid barrier that prevents the passage of solids and liquids therethrough;

b) an eyewear attachment element configured to attach or removably attach to eyewear;

c) an eyewear movement element configured to allow movement of the eyewear with respect to the solid barrier when said eyewear is attached;

wherein said eyewear movement element is configured such that attached eyewear may be moved into a first position where the lenses of the eyewear are positioned between the solid barrier and the eyes of a user wearing the face shield; the attached eyewear may be moved into a second position where the lenses of the eyewear are not positioned between the solid barrier and the eyes of a user wearing the face shield; and movement of the eyewear from the first position to the second position can be effectuated without removal of the face shield from the face of a user. Referring now to FIG. 3A, a face shield 30 having solid barrier 31 is depicted being worn by user 33 with eyewear 32. The face shield is supported by strap 34 which extends around the head of user 33. Eyewear 32 is attached (e.g., removably attached) to face shield 30 with one or more attachment elements 35. The attachment element may comprise ports designed to grip the frame of the eyewear such as those comprising hook and loop construction (e.g., Velcro®), adhesive, loops, clips, hooks, those which rely on frictional forces (e.g., rubber port) or combinations thereof. Attachment element 35 is attached to a movement element allowing for rotation of the eyewear away from the eyes of the user. As shown in FIG. 3B, the face shield comprises a movement element (not depicted) such as a ratchet or swivel located at the back of the head. The movement element is in communication with the attachment element allowing for a user to rotate 36 the eyewear 32 into a position away from the user's eyes without removal of the face shield.

In some embodiments, the eyewear is glasses (e.g., prescription glasses, reading glasses). The movement element may be configured to rotate the eyewear in the plane of facial symmetry (e.g., the glasses are rotated to the forehead of the user in the second position) as illustrated, for example, in FIG. 3B. In various implementations, the movement element is configured to allow linear movement of the eyewear element such as illustrated, for example, in FIG. 2B. In some embodiments, the movement element may be configured to rotate the eyewear in a plane substantially perpendicular to the plane of facial symmetry (e.g., the rotation plane has an angle with the facial symmetry plane of from 80° to 100°) as illustrated, for example, in FIG. 2C. In some embodiments, the face shield may comprise a handle removably attached to the frame of the eyewear, wherein the handle extends above the top portion of the face shield (i.e., the portion above the user's eyes) such that the user may move the handle to reposition the glasses as desired.

Kits are also provided which may comprise:

a) a solid barrier that prevents the passage of solids and liquids therethrough; wherein said solid barrier comprises one or more eyewear attachment elements configured to allow for an eyewear element to be removably attached to said solid barrier; and b) an eyewear element capable of being removably attached to said solid barrier comprising lenses which refract light into the eyes of a user wearing the face shield when the eyewear element is attached to the solid barrier.

Typically, the eyewear element comprises a frame portion attached (e.g., removably attached) to lenses which refract the light into the eyes of the user during the specific use of the face shield. In some embodiments, the eyewear element may comprise one or more pairs of interchangeable lenses, each pair of interchangeable lenses attachable to and removable from a lens receiving area of the frame portion, and wherein each interchangeable lens is configured to be inserted into one of the lens receiving areas; and a nose bridge portion removably attached to the frame portion. In some embodiments, the kit may comprise an eyewear element comprising a frame portion having one or more lens receiving areas. Eyewear elements include those described in U.S. Pat. No. 10,649,237, which is hereby incorporated by reference in its entirety.

The eyewear element may comprise lenses which correct a user's vision (i.e., prescriptive lenses). In some embodiments, the lenses may magnify an image such as those lenses typically used for reading. In some embodiments, the lenses may be are bifocal or trifocal lenses. The eyewear element (e.g., lenses), may comprises one or more coatings as well such as UV coating, anti-fog coating, scratch-resistance coating, and combinations thereof. For example, the lenses (e.g., polycarbonate lenses) comprise two or more of UV, anti-fog, and scratch-resistance coating. In certain embodiments, the lenses may comprise a hydrophilic coating to produce a long-lasting, durable anti-fog effect. The coating can include a molecular-level blend of at least two hydrophilic polymers. The coating can be made, for example, by a layer-by-layer assembly process, though other techniques can be used. The layer-by-layer assembly can be a water based process, thereby avoiding solvents and chemicals that can damage many plastic substrates (such as polycarbonate and poly(methyl methacrylate)) that are widely used in optical applications. The conformal coatings can be applied by, for example, a dip-, spin-, or spray-assembly process. The anti-fog coatings can be highly transparent and have highly effective antifogging performance under a variety of conditions. The durability of the coatings can be increased by a variety of common crosslinking and surface modification methods. In particular embodiments, the lenses are prescription lenses.

As various changes can be made in the above-described subject matter without departing from the scope and spirit of the present disclosure, it is intended that all subject matter contained in the above description, or defined in the appended claims, be interpreted as descriptive and illustrative of the present disclosure. Many modifications and variations of the present disclosure are possible in light of the above teachings. Accordingly, the present description is intended to embrace all such alternatives, modifications and variances which fall within the scope of the appended claims.

All documents cited or referenced herein and all documents cited or referenced in the herein cited documents, together with any manufacturer's instructions, descriptions, product specifications, and product sheets for any products mentioned herein or in any document incorporated by reference herein, are hereby incorporated by reference, and may be employed in the practice of the disclosure.

The invention claimed is:

1. A face shield comprising:

a) a solid barrier that prevents the passage of solids and liquids therethrough;

b) an eyewear attachment element configured to removably attach to eyewear;

c) an eyewear movement element comprising a swivel configured to allow movement of the eyewear with respect to the solid barrier when said eyewear is attached;

wherein said eyewear movement element is configured such that attached eyewear may be moved into a first position where the lenses of the eyewear are positioned between the solid barrier and the eyes of a user wearing the face shield; the attached eyewear may be moved into a second position where the lenses of the eyewear are not positioned between the solid barrier and the eyes of a user wearing the face shield; and movement of the eyewear from the first position to the second position can be effectuated without removal of the face shield from the face of a user.

2. The face shield according to claim 1, wherein said eyewear is glasses.

3. The face shield according to claim 1, wherein said movement element is configured to rotate the eyewear in the plane of facial symmetry.

4. The face shield according to claim 1, wherein said movement element is configured to rotate the eyewear in a plane perpendicular to the plane of facial symmetry.

5. The face shield according to claim 1, wherein said movement element is configured to rotate the eyewear in the plane of facial symmetry.

6. The face shield according to claim 1, wherein said movement element is configured to rotate the eyewear in a plane perpendicular to the plane of facial symmetry.

7. The face shield according to claim 1, wherein said face shield further comprises a handle connected to the eyewear attachment element and configured to allow a user to reposition the eyewear element in the first or second position without removal of the face shield from the user.

8. The face shield according to claim 1, wherein the swivel is located at the back of the head of the user.

9. The face shield according to claim 1, wherein the swivel is attached to the solid barrier.

10. The face shield according to claim 1, wherein the solid barrier covers the eyes, the nose, and the mouth of a user.

11. The face shield according to claim 1, wherein the eyewear attachment element is configured to grip the frame of the eyewear.

* * * * *